United States Patent [19]

Kusada et al.

[11] 4,094,182

[45] June 13, 1978

[54] DIE APPARATUS FOR PRESS MACHINE

[75] Inventors: Shohei Kusada; Tomoyoshi Kaneko, both of Komatsu, Japan

[73] Assignee: Kabushiki Kaisha Komatsu Seisakusho, Tokyo, Japan

[21] Appl. No.: 761,626

[22] Filed: Jan. 24, 1977

[30] Foreign Application Priority Data

Jan. 23, 1976 Japan ..... 51.005595

[51] Int. Cl.[2] ..... B21D 45/00

[52] U.S. Cl. ..... 72/344; 72/427

[58] Field of Search ..... 72/344, 463, 427; 83/98, 99, 168, 169

[56] References Cited

U.S. PATENT DOCUMENTS

| | | | |
|---|---|---|---|
| 1,636,691 | 7/1927 | Heance et al. | 83/98 X |
| 2,305,803 | 12/1942 | Bayer | 72/463 |
| 2,313,525 | 3/1943 | Edelman | 83/98 |
| 2,679,175 | 5/1954 | Davis | 72/344 X |
| 3,780,551 | 12/1973 | Lind | 72/344 |

FOREIGN PATENT DOCUMENTS

| | | | |
|---|---|---|---|
| 12,624 of | 1888 | United Kingdom | 72/344 |

*Primary Examiner*—Leon Gilden

*Attorney, Agent, or Firm*—Armstrong, Nikaido, Marmelstein & Kubovcik

[57] ABSTRACT

A die apparatus for press machine wherein compressed air may be introduced for blowing off surplus lubricant and particles deposited within a die.

The apparatus comprising a die set having a piercing hole therein, a cylindrical plate having a hole therein disposed within said die set, a die disposed on said cylindrical plate within said die set, and a knockout slidably disposed within said cylindrical plate, said knockout having a plurality of grooves on the upper and lower parts thereof.

3 Claims, 2 Drawing Figures

DIE APPARATUS FOR PRESS MACHINE

BACKGROUND OF THE INVENTION

This invention relates to a die apparatus for press machine.

In the die assembly of the press machine, lubrication for exposed components such as punch, flat die may be easily carried out, however on the other hand, lublication for the die hole may be difficult to be performed. When a die and a knockout associated therewith are exposed to an elevated temperature, it is difficult to cool them down.

Particles and residual or surplus lubricant due to die working are liable to adhere on the bottom part of the die and an upper surface of the knockout.

Therefore in a contineous operation of the die assembly, it is necessary to compensate insufficient lublication and cooling as well as to remove residual particles and lubricant from surfaces of the die assembly which results in a low performance of the operation.

Moreover, irregular wall thickness, pimples, and piping defects may be occured on or in the products.

Heretofore, cooling and blowing air from above the die assembly have been carried out to solve the above noted problems, however, it is difficult to solve the problems completely due to die hole being provided.

SUMMARY OF THE INVENTION

It is, therefore, an object of the present invention to provide a die apparatus for press machine wherein surplus lubricant and particles can be easily blown off by introducing compressed air.

Another object of the present invention is to provide a die apparatus for press machine wherein products with good quality can be efficiently produced.

According to the present invention, there is provided a die apparatus for press machine which comprises a die set having a piercing hole therein, a cylindrical plate having a hole therein disposed within said die set, a die disposed on said cylindrical plate within said die set, and a knockout slidably disposed within said cylindrical plate, said knockout having a plurality of first grooves provided on the upper part thereof and a plurality of second grooves provided on the lower part thereof, whereby compressed air may be introduced through the holes in said die set and said cylindrical plate for blowing off lubricant and particles deposited in said die.

Other objects, features and advantages of the present invention will be readily apparent from the following description taken in conjunction with the accompanying drawings.

DETAILED DESCRIPTION OF THE PREFERRED EMBODIMENT

Figure 1:
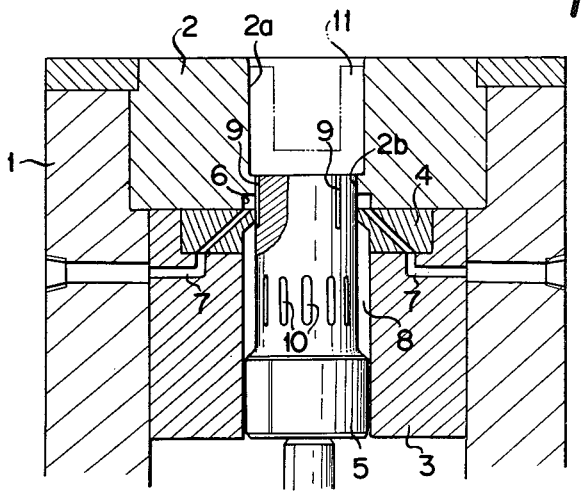
FIG. 1 is a cross-sectional view of the present invention wherein a knockout is positioned at its lowest position.

Referring to the drawings, reference numeral 1 denotes a die set, 2 represents a die with a die hole 2a. Disposed within the die set 1 are a cylindrical plate 3, a cylindrical piece plate 4 and a knockout 5.

Figure 2:
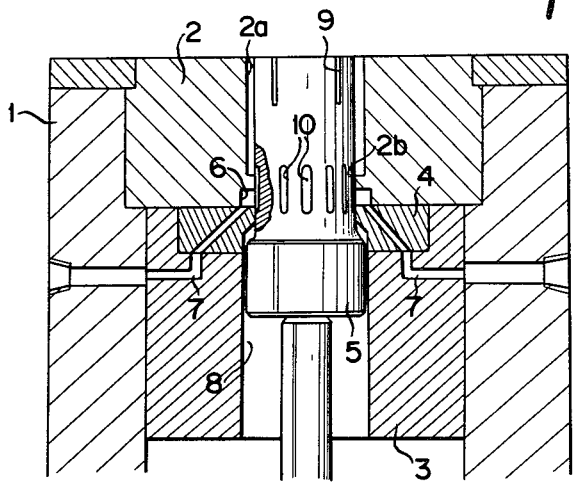
FIG. 2 is similar to FIG. 1 but showing the knockout being raised.

The knockout 5 is designed such that it constitutes a bottom wall of the die hole 2a of the die 2 when it is lowered as shown in FIG. 1 and the upper surface of the knockout 5 comes in alignment with the upper surface of the die 2 when it is raised as shown in FIG. 2.

Diameter of the knockout 5 is smaller than that of die hole 2a.

The knockout 5 is adapted to slide up and down on an inner surface of a cylindrical projection 2b as being a guide.

A cylindrical groove 6 is provided under the cylindrical projection 2b and a hole 7 for blowing air within the die set 1 and the cylindrical plate 3 to communicate outer opening with the cylindrical groove 6. A compressor (not shown) may be connectable to the hole 7 for blowing air into the die hole 2a via the cylindrical groove 6.

The inner diameter of the cylindrical plate 3 is larger than the outer diameter of the knockout 5 so as to provide an opening or gap 8. Provided on the upper part of the knockout 5 are a plurality of grooves 9 which communicate the inside of the die hole 2a with the opening 8 when the knockout 5 is lowered. A plurality of grooves 10 are provided on the lower part of the knockout 5 to communicate the inside of the die hole 2a with the cylindrical groove 6 when the knockout 5 is raised as shown in FIG. 2.

The cylindrical piece plate 4 is not always necessary being provided and when it is omitted, the cylindrical plate 3 should be constructed to include the cylindrical piece plate 4 instead.

With the above construction, when the knockout 5 is lowered as shown in FIG. 1, particles and residual or surplus lubricant left on the upper surface of the knockout 5 and the bottom part of the die hole 2a are leaked out through the grooves 9 into the opening 8 and then into the outside of the die assembly.

When the knockout 5 is raised to push out the finished product as shown in FIG. 2, compressed air normally under pressure of about 5 to 6 $kg/cm^2$ is introduced into the hole 7.

Thus particles and residual lubricant left on the bottom part of the die hole 2a are blown off by the compressed air introduced through the hole 7, the cylindrical groove 6 and the grooves 10.

The compressed air is gushed out in timed relationship with the movements of the knockout 5 so as to prevent cooling down the die assembly when an elevated temperature is necessary in operation. Should if cooling is necessary in operation, compressed air is being gushed out for a relatively long time.

It is to be understood that the foregoing description is merely illustrative of the preferred embodiment of the present invention and that the scope of the invention is not limited thereto, but is to be determined by the scope of the appended claims.

I claim:

1. A die apparatus for press machine comprising a die set having a piercing hole formed therein, a cylindrical plate having a hole formed therein disposed within said die set, a die disposed on said cylindrical plate within said die set, said die having a die hole formed therein, and a knockout slidably disposed within said cylindrical plate, said knockout having a plurality of first grooves formed in the upper part thereof and a plurality of second grooves formed in the lower part thereof, whereby compressed air may be introduced through the piercing hole in said die set, the hole in said cylindrical plate and the plurality of second grooves in said knockout into the die hole for blowing off lubricant and particles deposited in the die hole when said knockout is raised and wherein particles of residual oil may be leaked out through the plurality of first grooves to the outside of said die when said knockout is lowered.

2. A die apparatus for press machine of claim 1 further comprising a cylindrical piece plate having a hole therein disposed on said cylindrical plate.

3. A die apparatus for press machine of claim 1 wherein a cylindrical groove is provided at the bottom corner of the inner surface of said die.

* * * * *